US006481817B1

(12) United States Patent
Torgerson et al.

(10) Patent No.: US 6,481,817 B1
(45) Date of Patent: Nov. 19, 2002

(54) METHOD AND APPARATUS FOR EJECTING INK

(75) Inventors: Joseph M. Torgerson, Philomath; Bruce Cowger, Corvallis; David M. Hurst, Corvallis; Mark H. MacKenzie, Corvallis, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/702,231

(22) Filed: Oct. 30, 2000

(51) Int. Cl.[7] ..... B41J 29/38; B41J 2/205
(52) U.S. Cl. ..... 347/12; 347/15
(58) Field of Search ..... 347/12, 15

(56) References Cited

U.S. PATENT DOCUMENTS

| | | | | |
|---|---|---|---|---|
| 5,541,629 A | | 7/1996 | Saunders et al. | 347/12 |
| 5,604,519 A | | 2/1997 | Keefe et al. | 347/13 |
| 5,644,342 A | | 7/1997 | Argyres | 347/12 |
| 5,984,455 A | | 11/1999 | Anderson | 347/47 |
| 6,102,515 A | | 8/2000 | Edwards et al. | 347/17 |
| 6,176,569 B1 | | 1/2001 | Anderson et al. | 347/57 |
| 6,190,000 B1 | | 2/2001 | Krouss et al. | 347/40 |
| 6,286,922 B1 | | 9/2001 | Kondou | 347/10 |
| 6,299,292 B1 | * | 10/2001 | Edwards | 347/57 |

* cited by examiner

*Primary Examiner*—Raquel Yvette Gordon
*Assistant Examiner*—Alfred E. Dudding
(74) *Attorney, Agent, or Firm*—Kevin B. Sullivan

(57) ABSTRACT

The present disclosure relates to an inkjet printhead having a plurality of drop generators responsive to drive current and address signals for dispensing ink. The inkjet printhead includes first and second drop generators disposed on the printhead with each of the first and second drop generators configured to receive drive current from a drive current source. Each of the first and second drop generators is configured to receive address signals from a common address source. The inkjet printhead further includes a switching device connected between the common address source and each of the first and second drop generators. The switching device is responsive to enable signals for selectively providing the address signal to only one of the first and second drop generators.

29 Claims, 10 Drawing Sheets

METHOD AND APPARATUS FOR EJECTING INK

BACKGROUND OF THE INVENTION

This invention relates to inkjet printing devices, and more particularly to an inkjet printing device that includes a printhead portion that receives drop activation signals for selectively ejecting ink.

Inkjet printing systems frequently make use of an inkjet printhead mounted to a carriage which is moved back and forth across print media such as paper. As the printhead is moved across the print media, a control device selectively activates each of a plurality of drop generators within the printhead to eject or deposit ink droplets onto the print media to form images and text characters. An ink supply that is either carried with the printhead or remote from the printhead provides ink for replenishing the plurality of drop generators.

Individual drop generators are selectively activated by the use of an activation signal that is provided by the printing system to the printhead. In the case of thermal inkjet printing, each drop generator is activated by passing an electric current through a resistive element such as a resistor. In response to the electric current the resistor produces heat, that in turn, heats ink in a vaporization chamber adjacent the resistor. Once the ink reaches vaporization, a rapidly expanding vapor front forces ink within the vaporization chamber through an adjacent orifice or nozzle. Ink droplets ejected from the nozzles are deposited on print media to accomplish printing.

The electric current is frequently provided to individual resistors or drop generators by a switching device such as a field effect transistor (FET). The switching device is activated by a control signal that is provided to the control terminal of the switching device. Once activated the switching device enables the electric current to pass to the selected resistor. The electric current or drive current provided to each resistor is sometimes referred to as a drive current signal. The control signal for selectively activating the switching device associated with each resistor is sometimes referred to as an address signal.

In one previously used arrangement, a switching transistor is connected in series with each resistor. When active, the switching transistor allows a drive current to pass through each of the resistor and switching transistor. The resistor and switching transistor together form a drop generator. A plurality of these drop generators are then arranged in a logical two-dimensional array of drop generators having rows and columns. Each column of drop generators in the array are connected to a different source of drive current and with each drop generator within each column connected in a parallel connection between the source of drive current for that column. Each row of drop generators within the array is connected to a different address signal with each drop generator within each row connected to a common source of address signals for that row of drop generators. In this manner, any individual drop generator within the two-dimensional array of drop generators can be individually activated by activating the address signal corresponding to the drop generator of row and providing drive current from the source of drive current associated with the drop generator column. In this manner, the number of electrical interconnects required for the printhead is greatly reduced over providing drive and control signals for each individual drop generator associated with the printhead.

While the row and column addressing scheme previously discussed is capable of being implemented in relatively simple and relatively inexpensive technology tending to reduce printhead manufacturing costs, this technique suffers from the disadvantage of requiring relatively large number of bond pads for printheads having large numbers of drop generators. For printheads having in excess of three hundred drop generators, a number of bond pads tend to become a limiting factor when attempting to minimize the die size.

Another technique that has been previously been used makes use of transferring activation information to the printhead in a serial format. This drop generator activation information is rearranged using shift registers so that the proper drop generators can be activated. This technique, while greatly reducing the number of electrical interconnects, tends to require various logic functions as well as static memory elements. Printheads having various logic functions and memory elements require suitable technologies such as CMOS technology and tend to require a constant power supply. Printheads formed using CMOS technology tend to be more costly to manufacture than printheads using NMOS technology. The CMOS manufacturing process is a more complex manufacturing process than the NMOS manufacturing process that requires more masking steps that tend to increase the costs of the printhead. In addition, the requirement of a constant power supply tends to increase the cost of the printing device that must supply this constant power supply voltage to the printhead.

There is an ever present need for inkjet printheads that have fewer electrical interconnects between the printhead and the printing device thereby tending to reduce the overall costs of the printing system as well as the printhead itself. These printheads should be capable of being manufactured using a relatively inexpensive manufacturing technology that allows the printheads to be manufactured using high volume manufacturing techniques and have relatively low manufacturing costs. These printheads should allow information to be transferred between the printing device and the printhead in a reliable manner thereby allowing high print quality as well as reliable operation. Finally, these printheads should be capable of supporting large numbers of drop generators to provide printing systems that are capable of providing high print rates.

SUMMARY OF THE INVENTION

One aspect of the present invention is an inkjet printhead having a plurality of drop generators responsive to drive current and address signals for dispensing ink. The inkjet printhead includes first and second drop generators disposed on the printhead with each of the first and second drop generators configured to receive drive current from a drive current source. Each of the first and second drop generators is configured to receive address signals from a common address source. The inkjet printhead further includes a first switching device connected between the common address source and each of the first and second drop generators. The first switching device is responsive to enable signals for selectively providing the address signal to only one of the first and second drop generators.

Another aspect of the present invention is that the first drop generator includes a second switching device connected between a pair of drive current conductors coupled to the source of drive current. The second switching device is responsive to address active signals for selectively activating the first drop generator. Included with the second drop generator is a third switching device connected between a pair of drive current conductors coupled to the source of drive current. The third switching device is responsive to address active signals for selectively activating the second drop generator.

Yet another aspect of the present invention is that the first switching device includes a fourth and fifth switching device. The fourth switching device is connected between the source of address signals and the second switching device and the fifth switching device is connected between the source of address signals and the third switching device. The fourth switching device is responsive to enable signals for selectively providing address signals to the second switching device. The fifth switching device is responsive to enable signals for selectively providing address signals to the third switching device.

DETAILED DESCRIPTION OF THE PREFERRED EMBODIMENT

Figure 1:
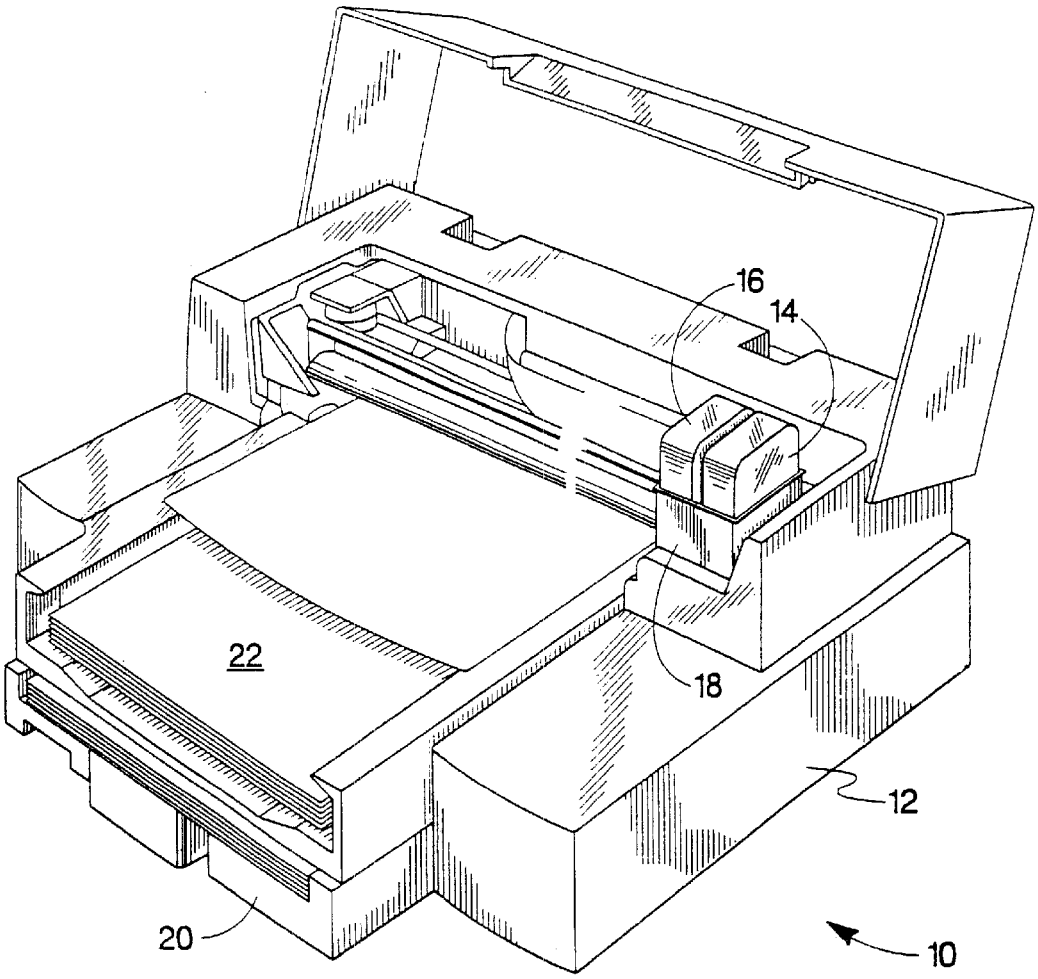
FIG. 1 depicts a printing system of the present invention that incorporates an inkjet print cartridge of the present invention for accomplishing printing on print media shown in a top perspective view.

FIG. 1 is a perspective view of one exemplary embodiment of an inkjet printing system 10 of the present invention shown with its cover open. The inkjet printing system 10 includes a printer portion 12 having at least one print cartridge 14 and 16 installed in a scanning carriage 18. The printing portion 12 includes a media tray 20 for receiving media 22. As the print media 22 is stepped through a print zone, the scanning carriage 18 moves the print cartridges 14 and 16 across the print media. The printer portion 12 selectively activates drop generators within a printhead portion (not shown) associated with each of the print cartridges 14 and 16 to deposit ink on the print media to thereby accomplish printing.

An important aspect of the present invention is a method for which the printer portion 12 transfers drop generator activation information to the print cartridges 14 and 16. This drop generator activation information is used by the printhead portion to activate drop generators as the print cartridges 14 and 16 are moved relative to the print media. Another aspect of the present invention is the printhead portion that makes use of the information provided by the printer portion 12. The method and apparatus of the present invention allows information to be passed between the printer portion 12 and the printhead with relatively few interconnects thereby tending to reduce the size of the printhead. In addition the method and apparatus of the present invention allows the printhead to be implemented without requiring clocked storage elements or complex logic functions thereby reducing the manufacturing costs of the printhead. The method and apparatus of the present invention will be discussed in more detail with respect to FIGS. 3–11.

Figure 2:
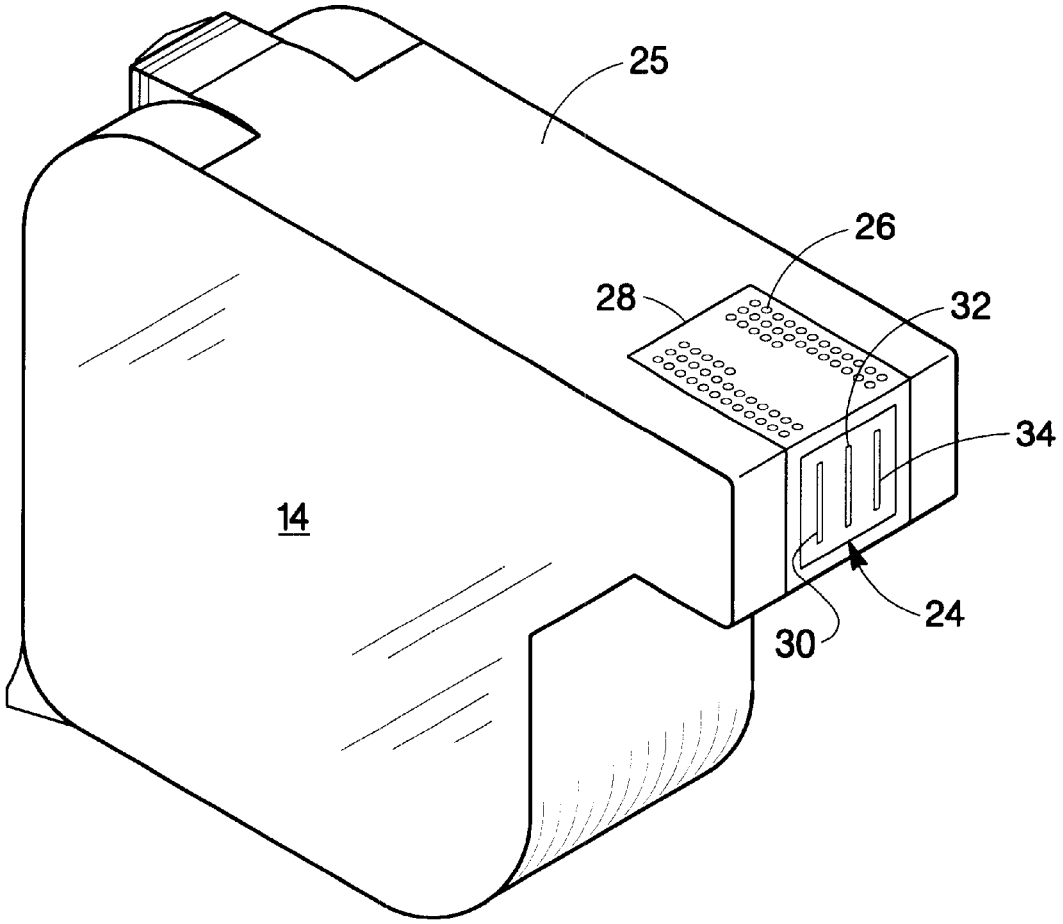
FIG. 2 depicts the inkjet print cartridge shown in FIG. 1 in isolation and viewed from a bottom perspective view.

FIG. 2 depicts a bottom perspective view of one preferred embodiment of the print cartridge 14 shown in FIG. 1. In the preferred embodiment, the cartridge 14 is a 3 color cartridge containing cyan, magenta, and yellow inks. In this preferred embodiment, a separate print cartridge 16 is provided for black ink. The present invention will herein be described with respect to this preferred embodiment by way of example only. There are numerous other configurations in which the method and apparatus of the present invention is also suitable. For example, the present invention is also suited to configurations wherein the printing system contains separate print cartridges for each color of ink used in printing. Alternatively, the present invention is applicable to printing systems wherein more than 4 ink colors are used such as in high-fidelity printing wherein 6 or more ink colors are used. Finally, the present invention is applicable to various types of print cartridges such as print cartridges which include an ink reservoir as shown in FIG. 2, or for print cartridges which are replenished with ink from a remote source of ink, either continuously or intermittently.

The ink cartridge 14 shown in FIG. 2 includes a printhead portion 24 that is responsive to activation signals from the printing system 12 for selectively depositing ink on media 22. In the preferred embodiment, the printhead 24 is defined on a substrate such as silicon. The printhead 24 is mounted to a cartridge body 25. The print cartridge 14 includes a plurality of electrical contacts 26 that are disposed and arranged on the cartridge body 25 so that when properly inserted into the scanning carriage, electrical contact is established between corresponding electrical contacts (not shown) associated with the printer portion 12. Each of the electrical contacts 26 is electrically connected to the printhead 24 by each of a plurality of electrical conductors (not shown). In this manner, activation signals from the printer portion 12 are provided to the inkjet printhead 24.

In the preferred embodiment, the electrical contacts 26 are defined in a flexible circuit 28. The flexible circuit 28 includes an insulating material such as polyimide and a conductive material such as copper. Conductors are defined within the flexible circuit to electrically connect each of the electrical contacts 26 to electrical contacts defined on the printhead 24. The printhead 24 is mounted and electrically connected to the flexible circuit 28 using a suitable technique such as tape automated bonding (TAB).

In the exemplary embodiment shown in FIG. 2, the print cartridge is a 3 color cartridge containing yellow, magenta, and cyan inks within a corresponding reservoir portion. The printhead 24 includes drop ejection portions 30, 32 and 34 for ejecting ink corresponding, respectively, to yellow, magenta, and cyan inks. The electrical contacts 26 include electrical contacts associated with activation signals for each of the yellow, magenta, and cyan drop generators 30, 32, 34, respectively.

In the preferred embodiment, the black ink cartridge 16 shown in FIG. 1 is similar to the color cartridge 14 shown in FIG. 2 except the black cartridge makes use of two drop ejection portions instead of three shown on the color cartridge 14. The method and apparatus of the present invention will be discussed herein with respect to the black cartridge 16. However, the method and apparatus of the present invention is applicable to the color cartridge 14 as well.

Figure 3:
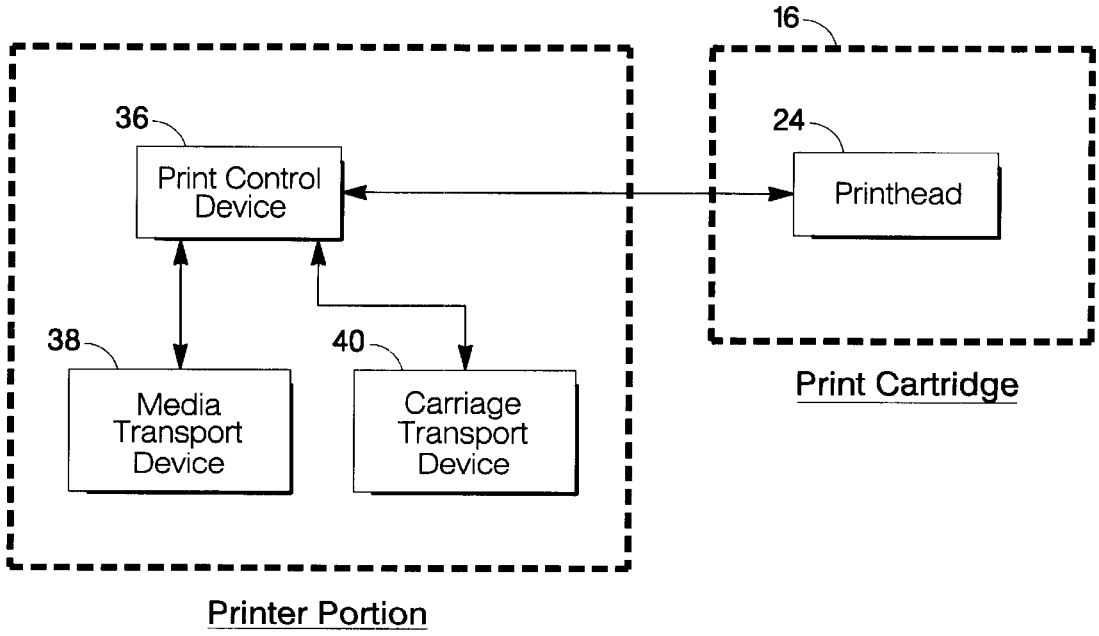
FIG. 3 is a simplified block diagram of the printing system shown in FIG. 1 that includes a printer portion and a printhead portion.

FIG. 3 depicts a simplified electrical block diagram of the printer portion 12 and one of the print cartridges 16. The printer portion 12 includes a print control device 36, a media transport device 38 and a carriage transport device 40. The print control device 36 provides control signals to the media transport device 38 to pass the media 22 through a print zone whereupon ink is deposited on the print media 22. In addition, the print control device 36 provides control signals for selectively moving the scanning carriage 18 across the media 22, thereby defining a print zone. As the media 22 is stepped past the printhead 24 or through the print zone the scanning carriage 18 is scanned across the print media 22. While the printhead 24 is scanned the print control device 36 provides activation signals to the printhead 24 to selectively deposit ink on print media to accomplish printing. Although, the printing system 10 is described herein as having the printhead 24 disposed in a scanning carriage there are other printing system 10 arrangements as well. These other arrangements involve other arrangements of achieving relative movement between the printhead and media such as having a fixed printhead portion and moving the media past the printhead or having fixed media and moving the printhead past the fixed media.

FIG. 3 is simplified to show only a single print cartridge 16. In general, the print control device 36 is electrically connected to each of the print cartridges 14 and 16. The print control device 36 provides activation signals to selectively deposit ink corresponding to each of the ink colors to be printed.

Figure 4:
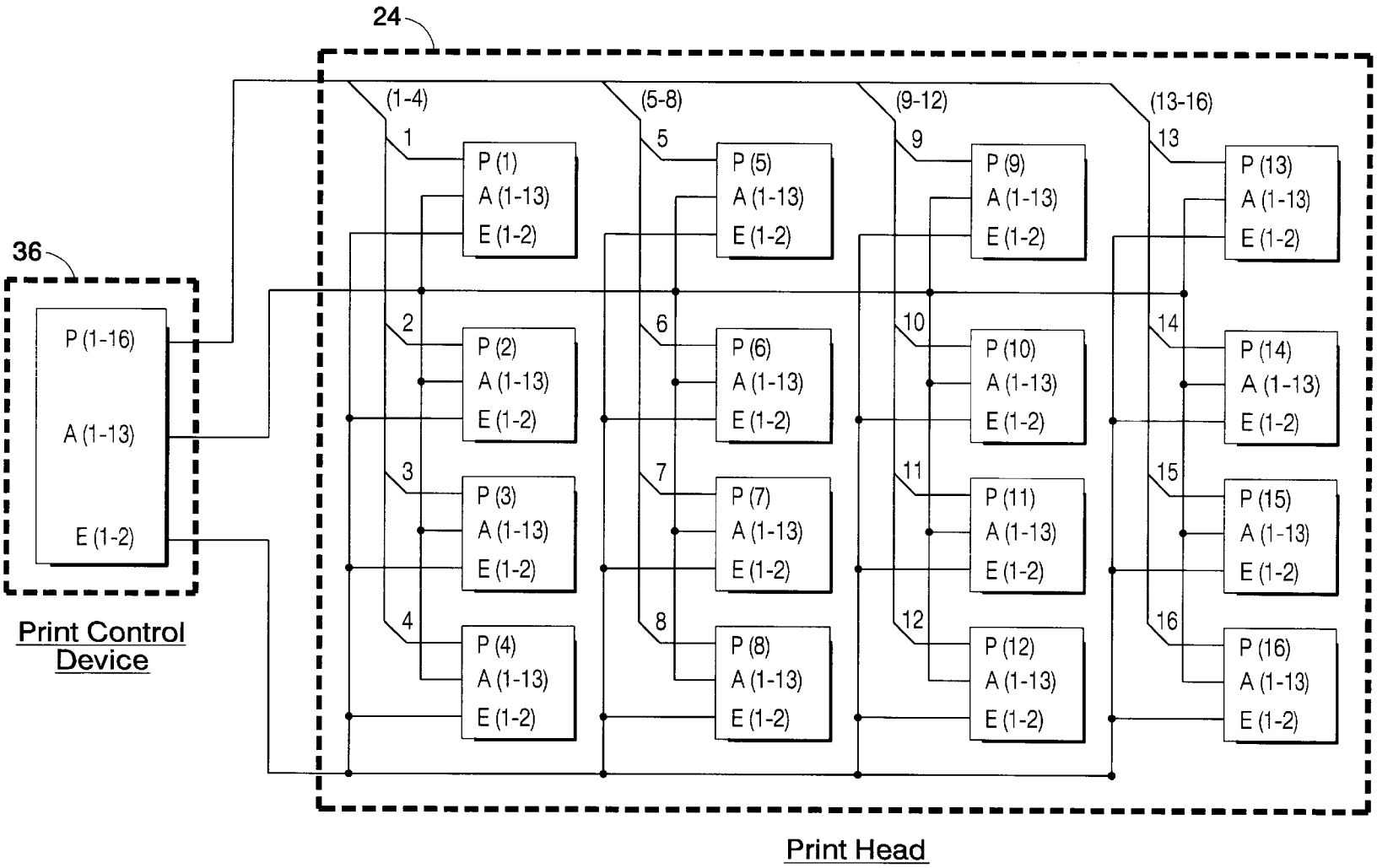
FIG. 4 is a block diagram showing further detail of one preferred embodiment of a print control device associated with the printer portion and the printhead shown with 16 groups of drop generators.

FIG. 4 depicts a simplified electrical block diagram showing greater detail of the print control device 36 within the printer portion 12 and the printhead 24 within the print cartridge 16. The print control device 36 includes a source of drive current, an address generator, and an enable generator. The source of drive current, address generator and enable generator provide drive current, address and enable signals under control of the control device or controller 36 to the printhead 24 for selectively activating each of a plurality of drop generators associated therewith.

In the preferred embodiment, the source of drive current provides 16 separate drive current signals designated P(1–16). Each drive current signal provides sufficient energy per unit time to activate the drop generator to eject ink. In the preferred embodiment, the address generator provides 13 separate address signals designated A(1–13) for selecting a group of drop generators. In this preferred embodiment the address signals are logic signals. Finally, in the preferred embodiment, the enable generator provides 2 enable signals designated E (1–2) for selecting a subgroup of drop generators from the selected group of drop generators.

The selected subgroup of drop generators is activated if drive current provided by the source of drive current is supplied. Further detail of the drive signals, address signals and enable signals will be discussed with respect to FIGS. 9–11.

The printhead 24 shown in FIG. 4 includes a plurality of groups of drop generators with each group of drop generators connected to a different source of drive current. In the preferred embodiment, the printhead 24 includes 16 groups of drop generators. The first group of drop generators is connected to the source of drive current labeled P(1), the second group of drop generators are each connected to the source of drive current designated P(2), the third group of drop generators is connected to the source of drive current designated P(3), and so on with the sixteenth group of drop generators each connected to the source of drive current designated P(16).

Each of the groups of drop generators shown in FIG. 4 are connected to each of the address signals designated A(1–13) provided by the address generator on the print control device 36. In addition, each of the groups of drop generators are connected to the two enable signals designated E(1–2) provided by the address generator on the print control device 36. Greater detail of each of the individual groups of drop generators designated will now be discussed with respect to FIG. 5.

Figure 5:
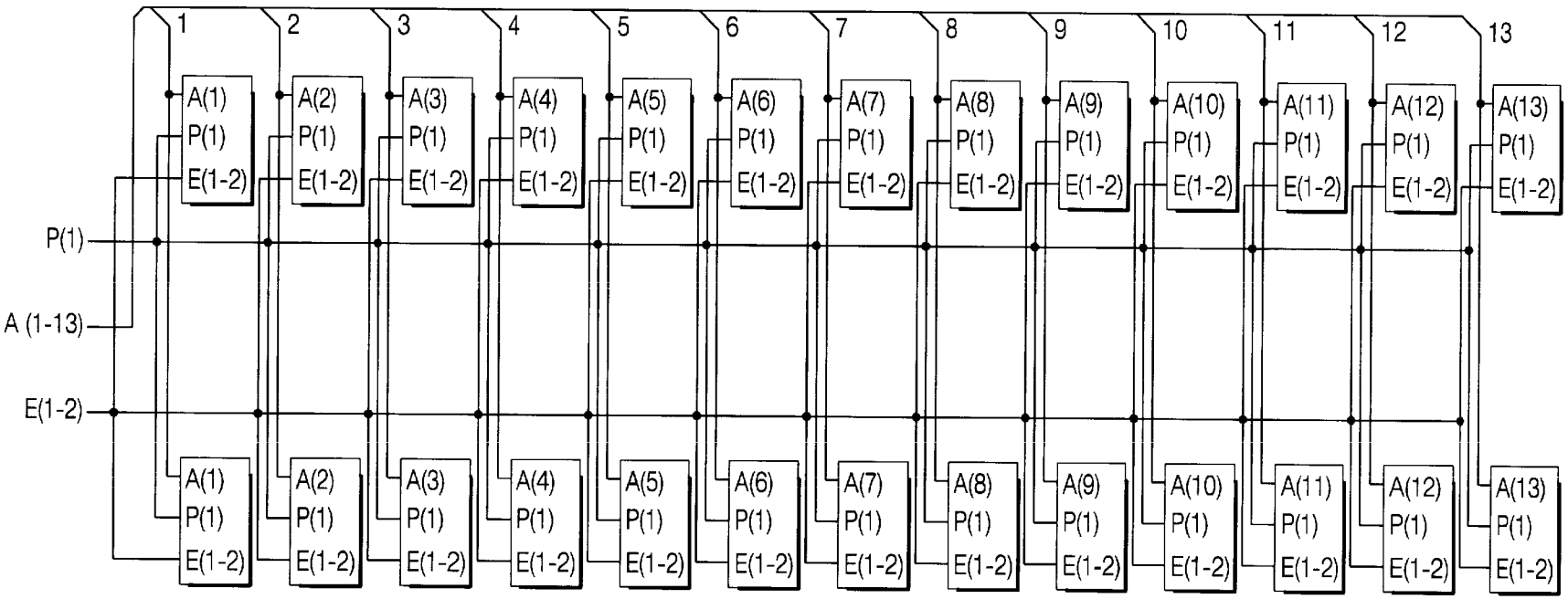
FIG. 5 is a block diagram showing further detail of one group of drop generators having 26 individual drop generators.

FIG. 5 is a block diagram representing a single group of drop generators from the plurality of groups of drop generators shown in FIG. 4. In the preferred embodiment, the single group of drop generators shown in FIG. 5 is a group of 26 individual drop generators each connected to a common source of drive current. The group of drop generators shown in FIG. 5 are all connected to the common source of drive current designated P(1) of FIG. 4.

The individual drop generators within the group of drop generators are organized in drop generator pairs with each pair of drop generators connected to a different source of address signals. For the embodiment shown in FIG. 5, the first pair of drop generators are connected to a source of address signals designated A(1), the second pair of drop generators are connected to a second source of address signals designated A(2), the third pair of drop generators are connected to a source of address signals designated A(3) and so on with the thirteenth pair of drop generators connected to the thirteenth source of address signals designated A(13).

Each of the 26 individual drop generators shown in FIG. 5 is also connected to the source of enable signals. In the preferred embodiment, the source of enable signals is a pair of enable signals designated E(1–2).

The remaining groups of drop generators shown in FIG. 4 that are connected to the remaining sources of drive current designated P(2) through P(16) are connected in a manner similar to the first group of drop generators shown in FIG. 5. Each of the remaining groups of drop generators are connected to a different source of drive current as designated in FIG. 4 instead of the source of drop current P(1) shown in FIG. 5. Greater detail of each individual drop generator shown in FIG. 5 will now be discussed with respect to FIG. 6.

Figure 6:
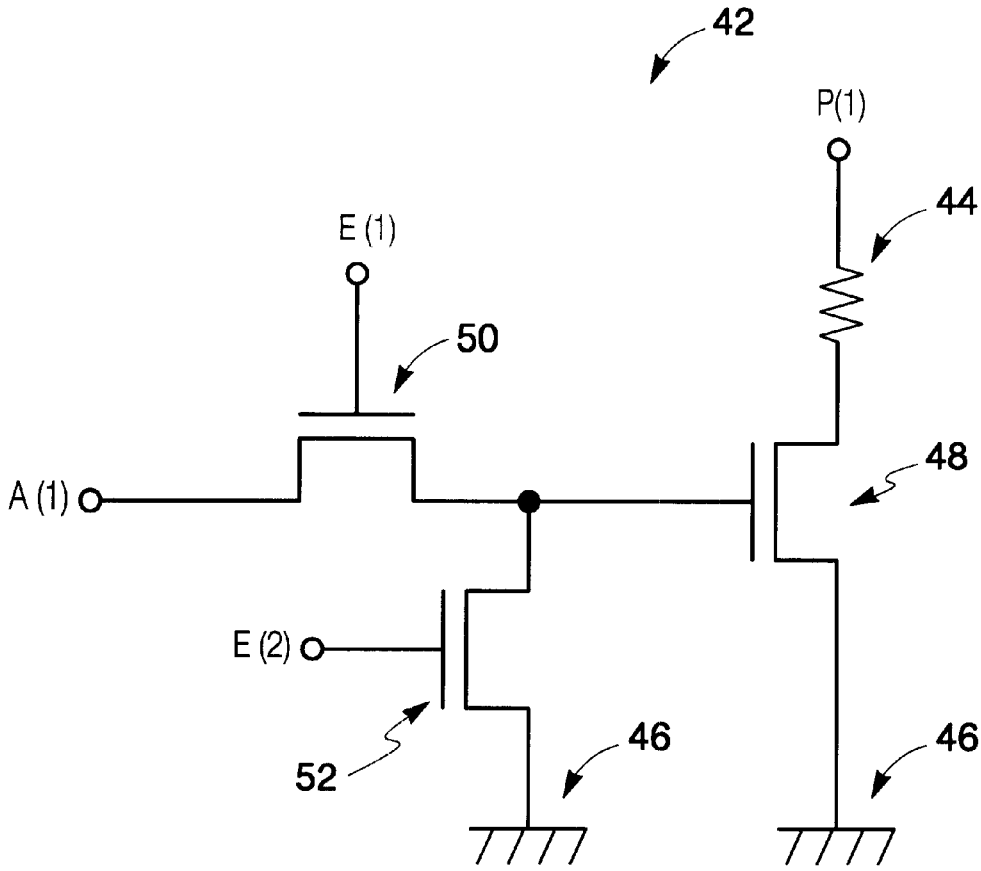
FIG. 6 is a schematic diagram showing further detail of one preferred embodiment of one individual drop generator of the present invention.
Figure 7:
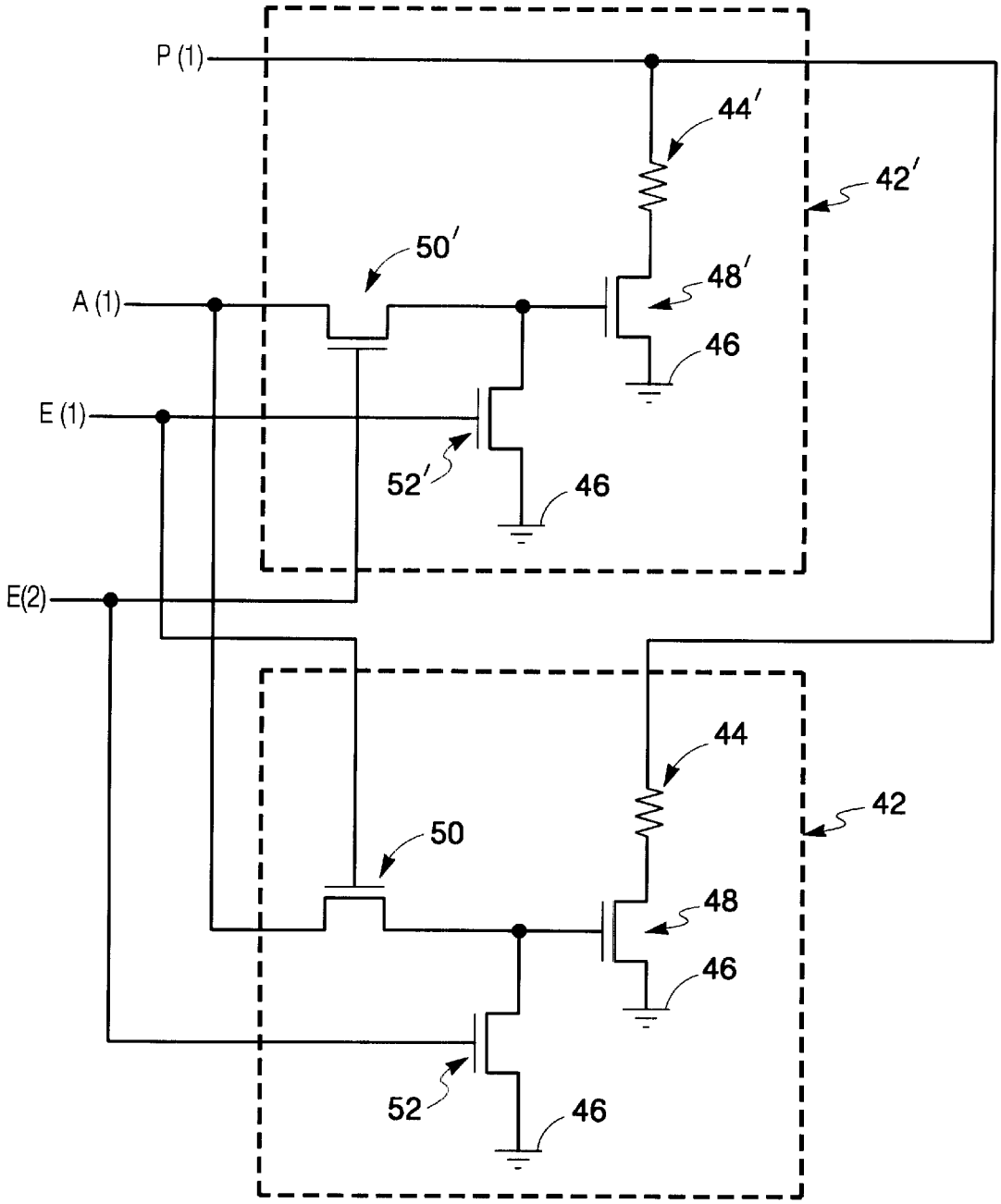
FIG. 7 is a schematic diagram showing two individual drop generators for the printhead of the present invention shown in FIG. 5.

FIG. 6 shows one preferred embodiment of an individual drop generator designated 42. The drop generator 42 represents one individual drop generator shown in FIG. 5. As shown in FIG. 5 two individual drop generators 42 make up a pair of drop generators 42 that is each connected to a common source of address signals. The individual drop generator shown in FIG. 6 represents one of the pair of drop generators 42 connected to address source 1 designated A(1) of FIG. 5. All sources of signals such as address signals A(1) and enable signals E(1–2) discussed with respect to FIGS. 6 and 7 are signals that are provided between the corresponding source of signals and the common reference point 46. In addition, the source of drive current is provided between the corresponding source of drive current designated P(1) and the common reference point 46.

The drop generator 42 includes a heating element 44 connected between the source of drive current. For the particular drop generator 42 shown in FIG. 6 the source of drive current is designated P(1). The heating element 44 is connected in series with a switching device 48 between the source of drive current P(1) and the common reference point 46. The switching device 48 includes a pair of controlled terminals connected between the heating element 44 and the common reference point 46. Also included with the switching device 48 is a control terminal for controlling the controlled terminals. The switching device 48 is responsive to activation signals at the control terminal for selectively allowing current to pass between the pair of controlled terminals. In this manner, activation of the control terminals allows drive current from the source of drive current designated P(1) to pass through the heating element 44 thereby producing heat energy that is sufficient to eject ink from the printhead 24.

In one preferred embodiment, the heating element 44 is a resistive heating element and the switching device 48 is a field effect transistor (FET) such as an NMOS transistor.

The drop generator 42 further includes a second switching device 50 and a third switching device 52 for controlling activation of the control terminal of the switching device 48. The second switching device has a pair of controlled terminals connected between a source of address signals and the control terminal of switching device 48. The third switching device 52 is connected between the control terminal of switching device 48 and the common reference point 46. Each of the second and third switching devices 50 and 52, respectively, selectively control the activation of the switching device 48.

The activation of switching device 48 is based on each of the address signal and enable signal. For the particular drop generator 42 shown in FIG. 6 the address signal is represented by A(1), the first enable signal represented by E(1) and a second enable signal represented by E(2). The first enable signal E(1) is connected to the control terminal of the second switching device 50. The second enable signal represented by E(2) is connected to the control terminal of the third switching device 52. By controlling the first and second enable signals, E(1–2), and the address signal, A(1), the switching device 48 is selectively activated to conduct current through the heating element 44 if drive current is present from the source of drive source P(1). Similarly, the switching device 48 is inactivated to prevent current from being conducted through the heating resistor 44 even if the source of drive current P(1) is active.

The switching device 48 is activated by the activation of the second switching device 50 and the presence of an active address signal at the source of address signals, A(1). In the preferred embodiment where the second switching device is a field effect transistor (FET) the controlled terminals associated with the second switching device are source and drain terminals. The drain terminal is connected to the source of address signals A(1) and the source terminal is connected to the controlled terminal of the first switching device 48. The control terminal for the FET transistor switching device 50 is a gate terminal. When the gate terminal, connected to the first enable signal E(1), is sufficiently positive relative to the source terminal and the source of address signals, A(1), provides a voltage at the drain terminal that is greater than the voltage at the source terminal then the second switching device 50 is activated.

The second switching device, if active, provides current from the source of address signals A(1) to the control terminal or gate of the switching device 48. This current, if sufficient, activates the switching device 48. The switching device 48, in the preferred embodiment, is a FET transistor having a drain and source as the controlled terminals with the drain connected to the heating element 44 and the source connected to the common reference terminal 46.

In the preferred embodiment, the switching device 48 has a gate capacitance between the gate and source terminals. Because this switching device 48 is relatively large to conduct relatively large currents through the heating device 44, then the gate to source capacitance associated with the switching device 48 tends to be relatively large. Therefore, to enable or activate the switching device 48, the gate or control terminal must be charged sufficiently so that the switching device 48 is activated to conduct between the source and drain. The control terminal is charged by the source of address signals A(1) if the second switching device 50 is active. The source of address signals A(1) provides current to charge the gate to source capacitance of the switching device 48. It is important that the third switching device 52 be inactive when the switching device 48 is active to prevent a low resistance path from being formed between the source of address signals A(1) and the common reference terminal 46. Therefore, the enable signal E(2) is inactive while the switching device 48 is active or conducting.

The switching device 48 is inactivated by activating the third switching device 52 to reduce the gate to source voltage sufficiently to inactivate the switching device 48. The third switching device 52 in the preferred embodiment is a FET transistor having drain and source as the controlled terminals with the drain connected to the control terminal of switching device 48. The control terminal is a gate terminal that is connected to the second source of enable signals E(2). The third switching device 52 is activated by activation of the second enable signal E(2) that provides a voltage at the gate that is sufficiently large relative to a voltage at the source of the third switching device 52. Activation of the third switching device 52 causes the controlled terminals or drain and source terminals to conduct thereby reducing a voltage between the control terminal or gate terminal of the switching device 48 and the source terminal of the switching device 48. By sufficiently reducing the voltage between the gate terminal and the source terminal of the switching device 48 the switching device 48 is prevented from being partially turned on by capacitive coupling.

While the third switching device 52 is active, the second switching 50 is inactive to prevent sinking large amounts of current from the source of address signals, A(1), to the common reference terminal 46. The operation of the individual drop generator 42 will be discussed in more detail with respect to the timing diagrams shown in FIGS. 8 through 11.

FIG. 7 shows greater detail of a pair of drop generators that are formed by the drop generator designated 42 and a drop generator designated 42'. Each of the drop generators 42 and 42' that form the pair of drop generators are identical to the drop generator 42 discussed previously with respect to FIG. 6. The pair of drop generators is each connected to a source of address signals represented by A(1) shown in FIG. 5. Each of the drop generators 42 and 42' are connected to a common source of drive current P(1) and common source of address signals A(1). However, the first and second enable signals E(1) and E(2), respectively, are connected differently in drop generator 42' from drop generator 42. In drop generator 42', the first enable signal E(1) is connected to the gate or control terminal of the third switching device 52' in contrast to drop generator 42 in which the first enable signal E(1) is connected to the gate or control terminal of the second switching device 50. Similarly, the second enable signal E(2) is connected to the gate or control terminal of the second switching device 50' in the drop generator 42' in contrast to the drop generator 42 where the second enable signal E(2) is connected to the gate or control terminal of the third switching device 52.

The connection of the first and second enable signals E1 and E2 for the pair of drop generators 42 and 42' ensures that only a single drop generator of the pair of drop generators will be activated at a given time. As will be discussed later, it is important that within the group of drop generators that are connected to a common source of drive current that no more than one of these drop generators is active at the same time. The drop generators that are connected to a common source of drive current tend to be positioned near each other on the printhead. Therefore, by ensuring that no more than one of the drop generators that are connected to a common source of drive current of these is active at the same time tends to prevent fluidic crosstalk between these proximately positioned drop generators.

In the preferred embodiment, each of the pairs of drop generators shown in FIG. 5 are connected in a manner similar to the pair of drop generators shown in FIG. 7. In addition, each of the groups of drop generators connected to a common source of drive current shown in FIG. 4 are connected in a manner similar to the group of drop generators shown in FIG. 5.

Figure 8:
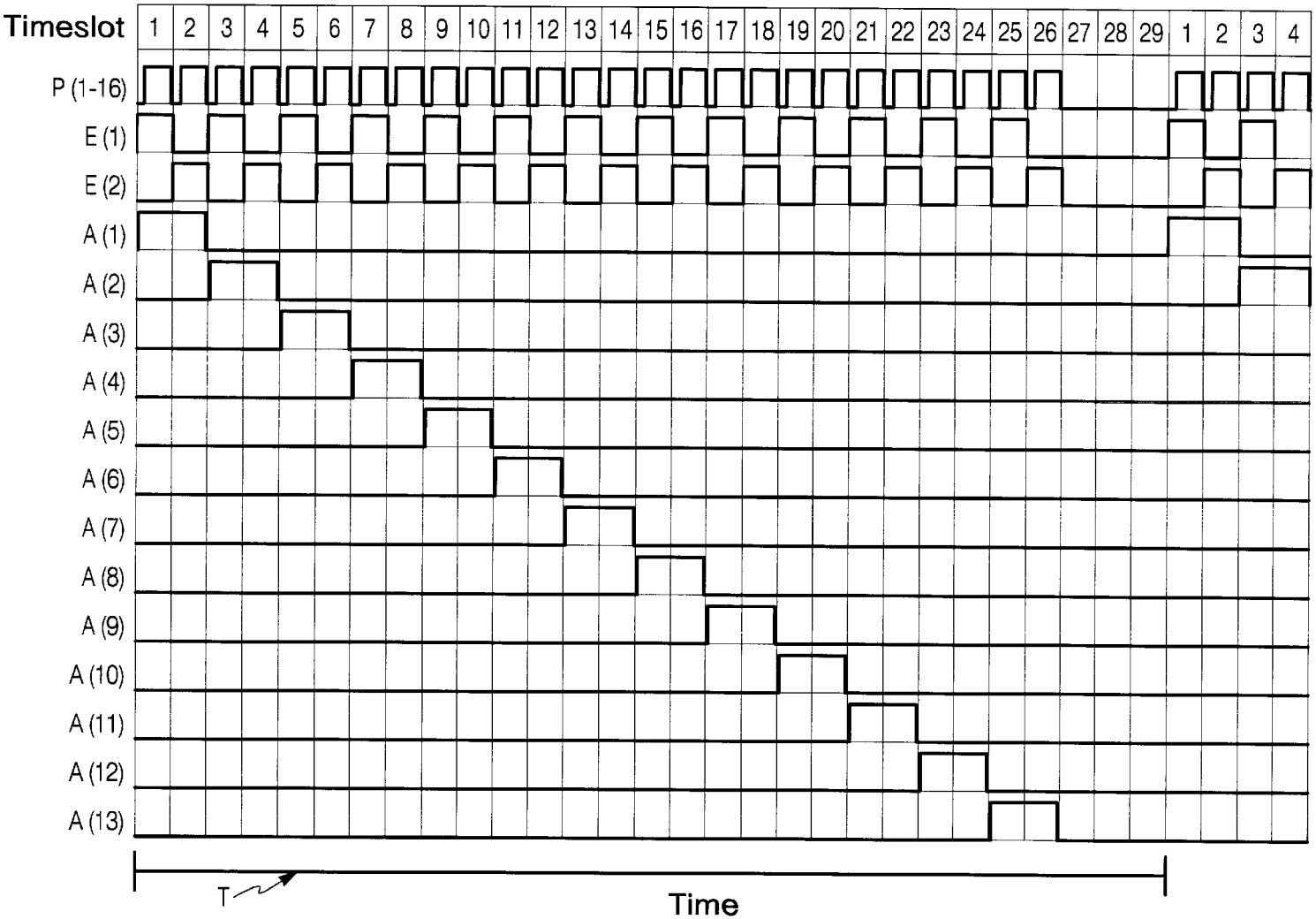
FIG. 8 is a timing diagram for operating the printhead of the present invention shown in FIG. 4.

FIG. 8 is a timing diagram illustrating the operation of printhead 24. The printhead 24 has a cycle time or period of time in which each of the drop generators on the printhead 24 can be activated. This period of time is represented by a time T shown in FIG. 8. The time T can be divided into 29 internals of time with each interval having the same duration. These intervals of time are presented by time slots 1 through 29. Each of the first 26 time slots represents a period in which a group of drop generators can be activated if the image to be printed so requires. Time slots 27, 28 and 29 represent intervals of time during a printhead cycle in which no drop generators are activated. The time slots 27, 28, and 29 are used by the printing system 10 to perform a variety of functions such as resynchronize the carrage 18 position and drop generator activation data and transfer activation data from the printer portion 12 to the printhead 24, to name a couple.

The 13 different sources of address signals represented by A(1) through A(13) are each shown. In addition, each of the first and second enable signals represented by E(1) and E(2) are also shown. Finally, each of the sources of drive current P(1–16) are also shown, grouped together. It can be seen from FIG. 8 that the address signals are each activated periodically with the period of activation for each address signal being equal to the cycle time T of the printhead 24. In addition, no more than one address signal is active at the same time. Each address signal is active during two consecutive time slots.

Each of the enable signals E(1) and E(2) are periodic signals having a period that is equal to two time slots. The enable signals E(1) and E(2) each have a duty cycle that is less than or equal to 50%. Each of the enable signals are out of phase with each other so that only one of enable signal E(1) or E(2) are active at the same time.

In operation, repeating patterns of address signals provided by each of the 13 sources of address signals A(1–13) is provided to the printhead 24 by the print control device 36. In addition, repeating patterns of enable signals for the first and second enable signals, E(1) and E(2), respectively, are also provided by the print control device 36 to the printhead 24. Both the address and enable signals are generated independent of the image description or image to be printed. Each of the 16 sources of drive current designated P(1–16) are selectively provided during each of the 26 time slots for each complete cycle for the inkjet printhead 24. The source of drive current P(1–16) is selectively applied based on the image description or the image to be printed. During the first time slot, the sources of drive current P(1–16) may all be active, none of them active or any number of them active, depending upon the image to be printed. Similarly, for time slots 2–26, each of the sources of drive current P (1–16) are individually selectively activated as required by the print control device 36 to form the image to be printed.

Figure 9:
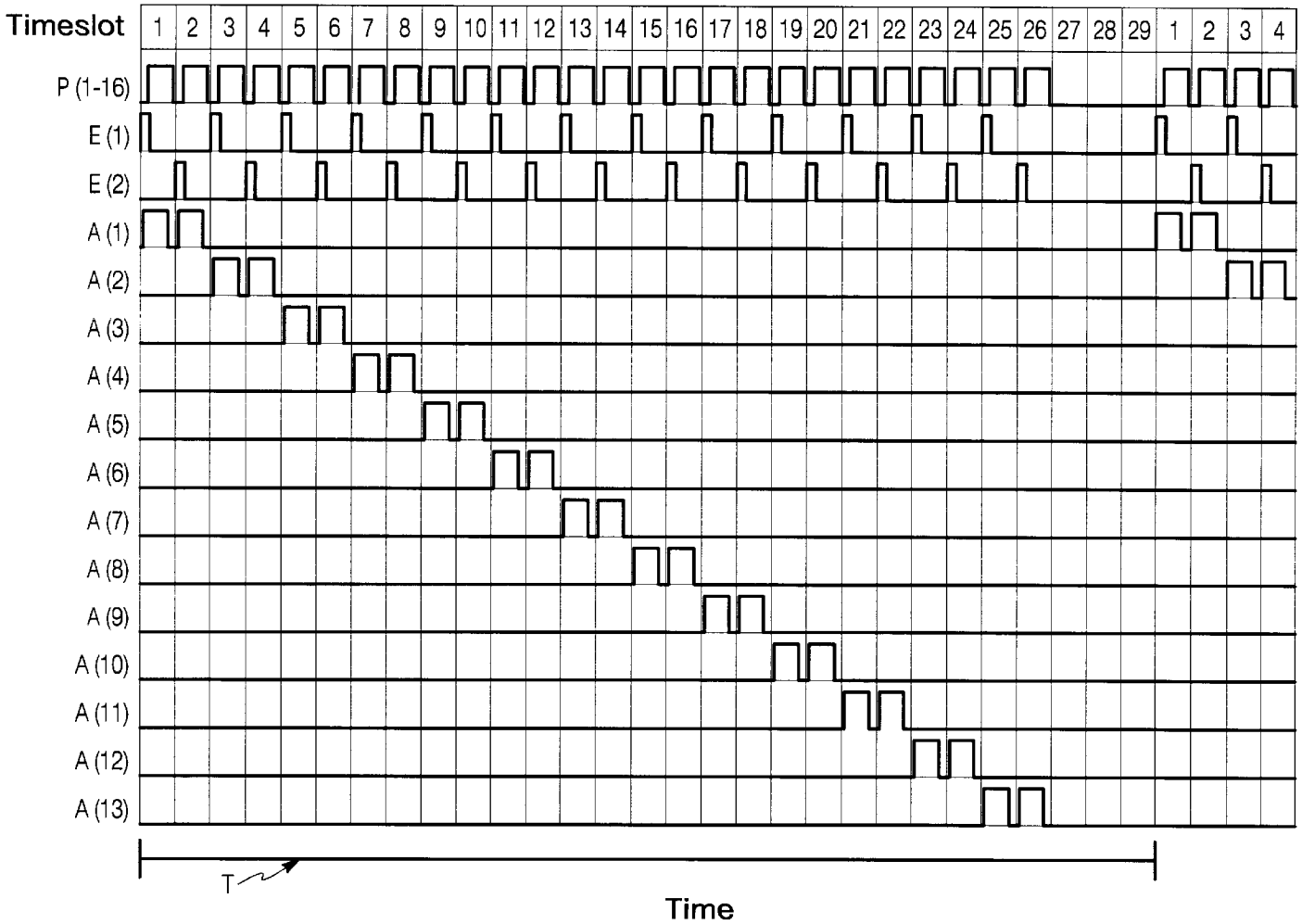
FIG. 9 is an alternative timing diagram for operating the printhead of the present invention shown in FIG. 4.

FIG. 9 is a preferred timing diagram for each of the sources of drive current P(1–16), sources of address signals A(1–13) and enable signals E(1–2) for the printhead 24 of the present invention. The timing in FIG. 9 is similar to the timing of FIG. 8 except that each source of address signals A(1–13) instead of remaining active over the entire two consecutive time slots shown in FIG. 8, each address is active for only a portion of each of the two time slots shown in FIG. 9. In this preferred embodiment, each of the address signals A(1–13) are active at the beginning of each time slot the address signal is active. In addition, the duty cycle of each of the first and second enable signals reduced from the nearly 50% duty cycle shown in FIG. 8. Further detail of the timing of the address enable and drive current will now be discussed with respect to FIGS. 10 and 11.

Figure 10:
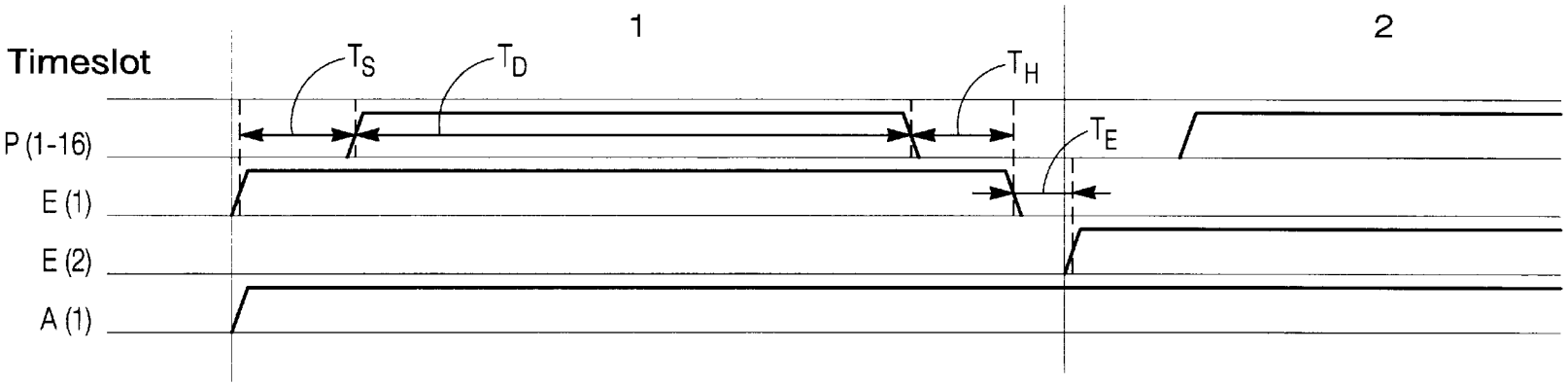
FIG. 10 is a detailed view of the timing for timeslots 1 and 2 of the timing diagram shown in FIG. 8.

FIG. 10 shows greater detail of time slots 1 and 2 for the timing diagram of described in FIG. 8. Because the only active address signal during time slot 1 and 2 is A(1) only the address signal A(1) need be shown in FIG. 10. As discussed previously, it is important that the first and second enable signals, E(1) and E(2) respectively, not be active at the same time to prevent providing a low resistance path to the common reference point 46 thereby sinking current from the source of address signals A(1–13). Therefore, the duty cycle of each of the first and second enable signals, E(1) and E(2) respectively, should be less than 50%. In FIG. 10 the time interval labeled $T_E$. between the transition from active to inactive for the first enable signal E(1) and the transition from inactive to active for the second enable signal E(2) should be greater than zero.

The enable signal should be active before drive current is provided by the source of drive current to ensure that the gate of capacitance of the switching transistor 48 is sufficiently charged to activate the drive transistor 48. The time interval labeled $T_S$ represents the time between the first enable E(1) active and the application of the drive current by the sources of drive current P(1–16). A similar time interval is required for the time between the second enable E(2) active and the application of the drive current by the sources of drive current P(1–16).

The enable signal E(1) should remain active for a period of time after the source of drive current P(1–16) transitions from active to inactive as designated $T_H$. This period of time $T_H$ referred to as hold time is sufficient to ensure that drive current is not present at the switching device 48 when the switching device 48 is inactivated. Inactivating the switching device 48 while the switching device 48 is conducting current between the controlled terminals can damage the switching device 48. The hold time $T_H$ provides margin to ensure the switching device 48 is not damaged. The duration of the drive current signal P(1–16) is represented by time interval labeled $T_D$.

The duration of drive current signal P(1–16) is selected to be sufficient to provide drive energy to the heating element 44 for optimum drop formation.

Figure 11:
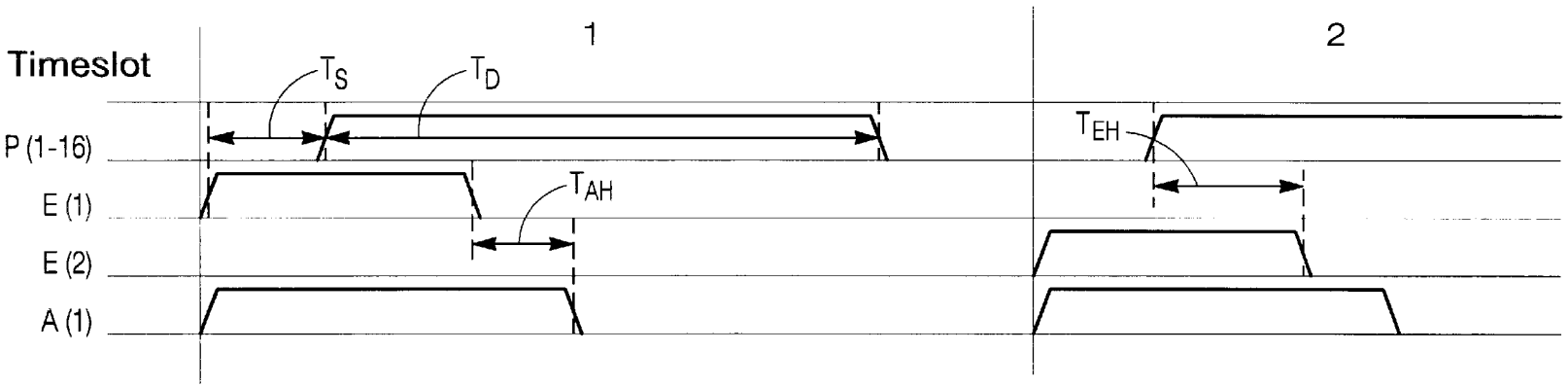
FIG. 11 is a detailed view of the timing for timeslots 1 and 2 of the alternative timing diagram shown in FIG. 9.

FIG. 11 shows further detail of the preferred timing for time slots 1 and 2 for the timing diagram of FIG. 9. As shown in FIG. 11 for time slot 1 the source of address signals A(1) and the source of enable signals E(1) does not remain active the entire duration that the source of drive current remains active. Once the gate capacitance of the switching transistor 48 and 48' shown in FIG. 7 is charged, the transistor 48 and 48' remain conducting the remaining duration that the source of drive current remains active. In this manner, the gate capacitance of the switching device 48 and 48' acts as a storage device or memory device that retains an activated state. The source of drive signals designated P(1–16) then provides the drive energy that is necessary for optimum drop formation.

Similar to FIG. 10 the time interval labeled $T_S$ represents the time between the first enable E(1) active and the application of the drive current by the sources of drive current P(1–16). An interval of time labeled TAH represents a hold time the source of address signals A(1) must remain active after the first enable signal E(1) is inactive to ensure the gate capacitance for transistor 48' is in the proper state. If the source of address signals were to change state before the first enable signal E(1) signal becomes inactive the wrong state of charge can exist at the gate of transistors 48 and 48'. Therefore, it is important that the time interval labeled $T_{AH}$ be greater than 0. An interval of time labeled $T_{EH}$ represents a hold time the second enable signal E(2) must be active after the source of drive current P(1–16) becomes active. During the time interval transistor 52 in FIG. 7 is activated by the second enable signal E(2) to discharge the gate capacitance of transistor 48. If this duration is not sufficiently long to discharge the gate of transistor 48 the heating element 44 may improperly be activated or partially activated.

Operation of the inkjet printhead 24 using the preferred timing shown FIG. 11 has important performance advantages over the use of the timing shown in FIG. 10. A minimum time required for each drop generator 42 activation for the timing shown in FIG. 10, is equal to the sum of time intervals $T_S$, $T_D$, $T_E$ and $T_H$. In contrast, the timing shown in FIG. 11 has a minimum time that is required for each drop generator 42 activation that is equal to the sum of time intervals $T_S$, and $T_D$. Because $T_D$ and $T_S$ is the same for each of the timing diagrams, the minimum time required for activation of a drop generator 42 is less in FIG. 11 than in FIG. 10. Both the address hold time $T_{AH}$ and the enable hold time $T_{EH}$ do not contribute to the minimum time interval for drop generator 42 activation in the preferred timing shown in FIG. 11 thereby allowing each time slot to be a smaller time interval than in FIG. 10. Reduction of the time interval required for each time slot reduces the cycle period designated T in FIGS. 8 and 9 thereby increasing the printing rate for the printhead 24.

The method and apparatus of the present invention allows 416 individual drop generators to be individually activated using 13 address signals, two enable signals, and 16 sources of drive current. In contrast, the use of previously used techniques whereby an array of drop generators having 16 columns and 26 rows would require 26 individual addresses to individually select each row with each column being selected by each source of drive current. The present invention provides significantly fewer electrical interconnects to address the same number of drop generators. The reduction of electrical interconnects reduces the size of the printhead 24 thereby significantly reducing the costs of the printhead 24.

Each individual drop generator 42 as shown in FIG. 6 does not require a constant power supply or bias circuit but instead relies on the input signals such as address, source of drive current, and enable signals to supply power or activate the drop generator 42. As discussed previously with respect to the timing of the signals, it is important that these signals be applied in the proper sequence in order to have proper operation of the drop generator 42. Because the drop generator 42 of the present invention does not require constant power, the drop generator 42 can be implemented in relatively simple technology such as NMOS which requires fewer manufacturing steps then more complex technology such as CMOS. Use of a technology that has lower manufacturing costs further reduces the costs of the printhead 24. Finally, the use of fewer electrical interconnects between the printer portion 36 and the printhead 24 tends to reduce the costs of the printer portion 36 as well as increase the reliability of the printing system 10.

Although the present invention has been described in terms of a preferred embodiment that makes use of 13 address signals, two enable signals, and 16 sources of drive current to selectively activate 416 individual drop generators other arrangements are also contemplated. For example, the present invention is suitable for selectively activating different numbers of individual drop generators. The selective activation of different numbers of individual nozzles may require different numbers of one or more of the address signals, enable signals, and sources of drive current to properly control different numbers of drop generators. In addition, there are other arrangements of address signals, enable signals, and sources of drive current to control the same number of drop generators as well

What is claimed is:

1. An inkjet printhead having a plurality of drop generators responsive to drive current and address signals for dispensing ink, the inkjet printhead comprising:

a plurality of subgroups of first and second drop generators disposed on the printhead that together form a group of drop generators with each drop generator of the group of drop generators configured for connection to a drive current source wherein within each subgroup, the first and second drop generators are configured to receive address signals from a common address source, and wherein each subgroup of first and second drop generators is configured for connection to a different source of address signals; and a first switching device connected between the common address source and each of the first and second drop generators of a subgroup, the switching device responsive to enable signals for selectively providing the address signal to only one of the first and second drop generators of the subgroup.

2. The inkjet printhead of claim 1 wherein each of the first and second drop generators include a heating device for selectively heating ink to eject ink from the printhead.

3. The inkjet printhead of claim 2 wherein each of the first and second drop generators include a second switching device connected in series with the heating device between a pair of drive current conductors coupled to the source of drive current, the second switching device responsive to address signals for selectively allowing drive current to pass through the heating device associated with one of the first and second drop generators.

4. The inkjet printhead of claim 1 wherein each of the first and second drop generators include a second switching device connected in a current path between a pair of drive current conductors coupled to the source of drive current, the second switching device responsive to address signals for selectively allowing drive current to pass therethrough.

5. The inkjet printhead of claim 1 wherein within each subgroup, the first drop generator includes a second switching device connected between a pair of drive current conductors coupled to the source of drive current, the second switching device responsive to address active signals for selectively activating the first drop generator and wherein the second drop generator includes a third switching device connected between the pair of drive current conductors, the third switching device responsive to address active signals for selectively activating the second drop generator.

6. The inkjet printhead of claim 5 wherein the first switching device comprises a fourth and fifth switching device with the fourth switching device connected between the source of address signals and the second switching device and with the fifth switching device connected between the source of address signals and the third switching device wherein the fourth switching device is responsive to enable signals for selectively providing address signals to the second switching device and wherein the fifth switching device is responsive to enable signals for selectively providing address signals to the third switching device.

7. The inkjet printhead of claim 1 wherein the first switching device comprises a transistor.

8. The inkjet printhead of claim 1 wherein the first switching device comprises an NMOS transistor.

9. The inkjet printhead of claim 1 wherein the printhead comprises a plurality of groups of drop generators with each group of drop generators of the plurality of groups of drop generators configured for connection to a different drive current source.

10. An inkjet printhead for use in an inkjet printing system for selectively depositing ink on media, the inkjet printhead comprising:

a first switching device having a pair of controlled terminals connected in series with a first heating element between a pair of drive current conductors and a control terminal, the first switching device responsive to an actuation signal at the control terminal for conducting current between the controlled terminals to activate the first heating device; and a second switching device having a pair of controlled terminals connected between an address terminal and the control terminal of the first switching device and a control terminal configured for connection to a source of enable signals, the second switching device responsive to enable signals for selectively allowing address signals at the address terminal to be provided to the control terminal of the first switching device.

11. The inkjet printhead of claim 10 further including a third switching device having a pair of controlled terminals connected between the control terminal of the first switching device and one of the pair of drive current conductors and a control terminal configured for connection to a source of second enable signals, the third switching device responsive to second enable signals for selectively conducting current between the control terminal of the first switching device and one of the pair of drive current conductors.

12. The inkjet printhead of claim 10 further including:

a third switching device having a pair of controlled terminals connected in series with a second heating device between the pair of drive current conductors and a control terminal, the third switching device responsive to an actuation signal at the control terminal for conducting current between the controlled terminals to activate the second heating device;

a fourth switching device having a pair of controlled terminals connected between the address terminal and the control terminal of the third switching device and a control terminal configured for connection to the source of enable signals, the fourth switching device responsive to enable signals for selectively allowing address signals at the address terminal to be provided to the control terminal of the third switching device for actuating the third switching device; and wherein the second and fourth switching devices are configured to activate only one of the first and third switching device at the same time.

13. The inkjet printhead of claim 10 wherein the printhead comprises a plurality of first and second switching devices, a plurality of pairs of drive current signals, and a plurality of address terminals, and wherein each of the plurality of first and second switching devices are connected to a different pair of drive current signals of the plurality of pairs of drive current signals and wherein each of the plurality of first and second switching devices are connected to a different address terminal of the plurality of address terminals.

14. An inkjet printhead for use in an inkjet printing system for depositing ink on media, the inkjet printhead comprising:

a plurality of drive current contacts each configured for connection to a source of drive current;

a plurality of address contacts each configured for connection to a source of address signals;

a plurality of enable contacts each configured for connection to a source of enable signals;

a plurality of drop generators arranged in groups, with each group electrically connected to one of the plurality of drive current contacts, with each of the plurality of drive current contacts connected to a different source of drive current, with each group of drop generators having individual drop generators arranged in pairs, with each pair electrically connected to one of the plurality of address contacts, and with each of the pairs of drop generators in each group connected to a different address contact; and wherein each drop generator is activated if drive current is provided to the drive current contact and the address contact corresponding to the drop generator is active and wherein only one drop generator associated with the pair of drop generators is active with the active drop generator selected based on the enable signal.

15. The inkjet printhead of claim 14 wherein the plurality of address contacts is equal to 13 and the plurality of drive current contacts is equal to 16 and wherein the plurality of enable contacts is equal to 2, wherein 16 drop generators can be activated at the same time.

16. An inkjet printhead for use in an inkjet printing system for depositing ink on media, the inkjet printhead comprising:

a plurality of drive current contacts each configured for connection to a source of drive current;

a plurality of address contacts each configured for connection to a source of address signals;

a plurality of enable contacts each configured for connection to a source of enable signals; and a plurality of drop generators for ejecting ink, the plurality of drop generators being divided into a plurality of groups of drop generators that can be activated at the same time, the plurality of groups being equal to the plurality of drive current contacts and wherein the size of each of the plurality of groups being equal to the plurality of address contacts multiplied by the plurality of enable contacts.

17. The inkjet printhead of claim 16 wherein the plurality of address contacts is equal to 13 and wherein the plurality of enable contacts is equal to 2.

18. An inkjet printhead for use in an inkjet printing system for depositing ink on media, the inkjet printhead having a plurality of drop generators for selectively ejecting ink in response to activation of each of a drive current signal and an address signal, the inkjet printhead comprising:

a selection device responsive to selection signals for selecting a particular drop generator from more than one drop generators; and wherein the more than one drop generators share a common address signal and a common drive current signal and wherein the selection device selects a particular drop generator from the more than one drop generators for activation based on the address and drive current signals.

19. A method for selecting a particular drop generator from a plurality of drop generators disposed on a drop ejection device, the method comprising:

providing a drive current to at least one drop generator on the drop ejection device;

providing an address signal that is common to more than one drop generator;

providing a selection signal for selecting a particular drop generator from a plurality of drop generators each having corresponding address and drive signals provided thereto so that only one of the plurality of drop generators identified by the selection signal is activated.

20. A method for activating a particular drop generator from a plurality of drop generators disposed on an inkjet printhead, the method comprising:

receiving a drive current signal, the drive current signal being provided to a group of drop generators of the plurality of drop generators, the group of drop generators including the particular drop generator;

receiving an address signal for identifying a subgroup of drop generators from the group of drop generators, the subgroup of drop generators including the particular drop generator; and receiving a select signal for selecting the particular drop generator from the subgroup of drop generators specified by the address signal, wherein only the selected drop generator of the subgroup of drop generators is activated for a given set of drive current, address and select signals.

21. The method of claim 20 wherein the subgroup of drop generators is two drop generators.

22. The inkjet printhead of claim 14 wherein a ratio of the plurality of address contacts to the plurality of enable contacts is approximately 6.5 to 1.

23. The inkjet printhead of claim 14 wherein the plurality of address contacts include A address contacts, the plurality of enable contacts include E enable contacts, and the plurality of drive contacts include D drive current contacts, and wherein the plurality of drop generators include (A×E×D) drop generators.

24. The inkjet printhead of claim 16 wherein a ratio of the plurality of address contacts to the plurality of enable contacts is approximately 6.5 to 1.

25. The inkjet printhead of claim 16 wherein the number of plurality of drop generators in the printhead is equal to the number of plurality of address contacts multiplied by the number of plurality of enable contacts multiplied by the number of plurality of drive current contacts.

26. An inkjet printhead for use in an inkjet printing system for selectively depositing ink on media, the inkjet printhead comprising:

first switching means having a pair of controlled terminals connected in series with a first heating element between a pair of drive current conductors and a control terminal, the first switching means conducting current between the controlled terminals to activate the first heating device in response to an actuation signal at the control terminal; and second switching means having a pair of controlled terminals connected between an address terminal and the control terminal of the first switching device and a control terminal configured for connection to a source of enable signals, the second switching means selectively allowing address signals at the address terminal to be provided to the control terminal of the first switching device in response to enable signals.

27. An inkjet printhead for use in an inkjet printing system for depositing ink on media, the inkjet printhead comprising:

a plurality of drop generators for selectively ejecting ink in response to activation of each of a drive current signal and an address signal; and selection means for selecting a particular drop generator from a subgroup of drop generators in response to selection signals, wherein the subgroup of drop generators share a common address signal and a common drive current signal and wherein the selection means selects a particular drop generator from the subgroup of drop generators for activation based on the address and drive current signals.

28. A drop ejection comprising:

drop generators;

means for providing a drive current to at least one drop generator;

means for providing an address signal that is common to more than one drop generator; and mean for providing a selection signal for selecting a particular drop generator from a plurality of drop generators each having corresponding address and drive signals provided thereto so that only one of the plurality of drop generators identified by the selection signal is activated.

29. An inkjet printhead comprising:

a plurality of drop generators;

means for receiving a drive current signal and providing the drive current signal to a group of drop generators of the plurality of drop generators, the group of drop generators including a particular drop generator;

means for receiving an address signal for identifying a subgroup of drop generators from the group of drop generators, the subgroup of drop generators including the particular drop generator; and means for receiving a select signal for selecting the particular drop generator from the subgroup of drop generators specified by the address signal, wherein only the selected drop generator of the subgroup of drop generators is activated for a given set of drive current, address, and select signals.

* * * * *